US008905249B2

(12) United States Patent
Whitacre

(10) Patent No.: US 8,905,249 B2
(45) Date of Patent: Dec. 9, 2014

(54) SPACE DIVIDER AND COMPONENTS

(75) Inventor: R. Dru Whitacre, Little Falls, NJ (US)

(73) Assignee: R. Dru Whitacre, Little Falls, NJ (US)

( * ) Notice: Subject to any disclaimer, the term of this patent is extended or adjusted under 35 U.S.C. 154(b) by 499 days.

(21) Appl. No.: 11/516,820

(22) Filed: Sep. 7, 2006

(65) Prior Publication Data

US 2008/0061021 A1 Mar. 13, 2008

(51) Int. Cl.
*A47B 57/30* (2006.01)
*A47B 96/14* (2006.01)

(52) U.S. Cl.
USPC ..... 211/204; 248/218.4

(58) Field of Classification Search
USPC ..... 211/85.3, 89.01, 100, 105, 105.1, 107, 211/123, 124, 182, 189, 191, 196, 204, 205, 211/206; 248/218.4, 219.3, 219.4, 220.22, 248/230.4, 231.51; 403/384, 385, 398, 399
See application file for complete search history.

(56) References Cited

U.S. PATENT DOCUMENTS

| | | | | | |
|---|---|---|---|---|---|
| 161,517 | A | * | 3/1875 | Keam | 248/229.1 |
| 632,629 | A | * | 9/1899 | Best | 211/110 |
| 780,229 | A | * | 1/1905 | Rodeheaver | 211/110 |
| 850,658 | A | * | 4/1907 | Koonce | 312/6 |
| 969,365 | A | * | 9/1910 | Gruber | 248/229.12 |
| 1,008,477 | A | * | 11/1911 | Kohn | 211/204 |
| 1,049,858 | A | * | 1/1913 | Hennessy | 135/120.2 |
| 1,064,734 | A | * | 6/1913 | Howe | 211/107 |
| 1,260,234 | A | * | 3/1918 | Menzl | 211/123 |
| 1,374,495 | A | * | 4/1921 | Etan | 211/107 |
| 1,510,272 | A | * | 9/1924 | Harmount | 211/204 |
| 1,696,579 | A | * | 12/1928 | Miller | 211/204 |
| 1,706,214 | A | * | 3/1929 | Davidson | 403/385 |
| 1,893,702 | A | * | 1/1933 | Glenn | 248/218.4 |
| 2,166,533 | A | * | 7/1939 | Oettel | 248/231.51 |
| 2,897,013 | A | * | 7/1959 | Delp | 52/645 |
| 2,897,911 | A | * | 8/1959 | Bowers | 182/155 |
| 2,947,422 | A | * | 8/1960 | Sudbery | 211/47 |
| 2,963,173 | A | * | 12/1960 | Barnes | 211/189 |
| 3,188,037 | A | * | 6/1965 | Hinrichs | 248/223.41 |
| 3,325,228 | A | * | 6/1967 | Lien | 403/188 |
| 3,389,882 | A | * | 6/1968 | Schlosser | 248/125.1 |
| 3,458,051 | A | * | 7/1969 | Zeman et al. | 211/124 |
| 3,503,525 | A | * | 3/1970 | Loebner | 211/206 |
| 3,532,224 | A | * | 10/1970 | Grubb et al. | 211/206 |
| 3,561,712 | A | * | 2/1971 | Newsome | 211/107 |
| 3,640,498 | A | * | 2/1972 | Aleks | 248/218.4 |
| 3,871,784 | A | * | 3/1975 | Van Horn | 403/236 |
| 4,036,371 | A | * | 7/1977 | Michel | 211/182 |
| 4,250,679 | A | * | 2/1981 | Burg | 52/655.1 |
| 4,338,875 | A | * | 7/1982 | Lisowski | 114/221 R |
| 4,361,914 | A | * | 12/1982 | Oliver | 4/605 |
| 4,624,374 | A | * | 11/1986 | Murtaugh | 211/60.1 |
| 5,074,506 | A | * | 12/1991 | Larsen | 248/309.1 |

(Continued)

*Primary Examiner* — Joshua Rodden
(74) *Attorney, Agent, or Firm* — Morris I. Pollack

(57) ABSTRACT

Utilization of event drapery for visual aids, and similar purposes is facilitated by insertion of an intermediate support bar between vertically disposed and relatively spaced posts supported at their bottoms by base plates and secured at their tops by an upper support bar. A clamp, positionable and securable, at any one of a relatively infinite number of positions along each post, functions to secure support bar receivers in place which, in turn, receive respective ends of the intermediate support bar to facilitate disposition of the visual aid and further event drapery. A base plate supports a pair of vertical posts and facilitates positioning two sets of drapes back to back.

12 Claims, 8 Drawing Sheets

(56) References Cited

U.S. PATENT DOCUMENTS

| | | | | |
|---|---|---|---|---|
| 5,154,386 | A * | 10/1992 | Heck | 248/230.5 |
| 5,325,620 | A * | 7/1994 | Reed et al. | 43/21.2 |
| 5,718,344 | A * | 2/1998 | Joldeson et al. | 211/206 |
| 6,186,383 | B1 * | 2/2001 | Kobdish | 224/420 |
| 6,390,311 | B1 * | 5/2002 | Belokin | 211/204 |
| 6,796,608 | B2 * | 9/2004 | Ventimiglia et al. | 297/217.1 |
| 6,913,422 | B2 * | 7/2005 | Rogers | 405/272 |
| 2002/0096610 | A1 * | 7/2002 | Fernandez | 248/218.4 |
| 2006/0144805 | A1 * | 7/2006 | Wang | 211/37 |
| 2007/0163974 | A1 * | 7/2007 | Lai | 211/85.3 |

* cited by examiner

SPACE DIVIDER AND COMPONENTS

BACKGROUND OF THE INVENTION

1. Field of the Application

This invention relates to space dividers and enhancers; and especially such dividers and enhancers which utilize uprights with horizontal supports disposed there between for positioning fabrics such as drapes, and/or other materials, to enhance the appearance of, or divide, a space and provide the same with one or more visual aids.

2. Description of Prior Art

It is often necessary to temporarily divide a space into a number of smaller spaces for trade show, conference, craft show and other similar purposes; or to reduce the size of the space to accommodate a function that does not require a space of the size then available or to decorate temporarily. Such space dividing is generally accomplished by the use of screens and/or space dividers which generally utilize vertically disposed posts or uprights; disposed in spaced relationships; supported at their lower ends by base plates, or the like; and positioned on the ground or floor; and secured together at their upper ends by hooked horizontal support bars. The resulting space between the uprights and under the upper support is filled by a panel or panels of material, which could include drapes or the like. Sand bags or similar weighted members are often used to stabilize and counterbalance the assembled space dividers. When the uprights are not tall enough, upright extensions may be attached to the top of the base upright.

Upper ends of the spaced uprights are usually secured in spaced relationship by upper supports, usually tubular or other shaped bars, with end caps that may carry hook ends for insertion and disposition in slots disposed at the upper end of the uprights or upright extensions. Additional slots may be formed at various spacings through the uprights for additional cross-supports but placement of such additional cross-supports are then limited to the location of the pre-formed slots. Alternatively, the height of the uprights are adjusted via telescopic pipe within a pipe.

Some examples of space dividers referred to above are shown in: U.S. Pat. No. 4,842,035 patented on Jun. 27, 1989 to O. Thompson for "Space Divider and Framing Members Therefor"; U.S. Pat. No. 5,680,737 patented on Oct. 28, 1997 to G. D. Shelpline for "Structural Connector Hub for Exhibit Booths"; U.S. Pat. No. 6,553,724 patented on Apr. 29, 2003 to R. A. Bigler for "Panel and Trade Show Booth Made Therefrom"; and U.S. Pat. No. 6,712,118 patented on Mar. 30, 2004 to J. M. Nussdorf for "Portable Exhibition Frame Assembly". However, the respective openings, between the uprights and horizontal supports, for the above can only be filled in by panels of space dividing materials and would not also readily accommodate and position a visual aid or visual aids for subsequent use.

At times it is desirable to position a pair of space dividers in close proximity to each other. However, to do so as shown and described in U.S. Pat. No. 4,213,492 patented on Jul. 22, 1980 to G. E. Guebert, et al. for "Drapery Rod Clip" requires that a clip supported space divider drape be positioned over and clipped to the support rod of a rod supported space divider drape, which may be difficult and possibly damage the rod supported drape.

SUMMARY OF THE INVENTION

It is, therefore, an object of this invention to provide new and novel space dividers and enhancers.

It is another object of this invention to provide new and novel space dividers and enhancers which facilitate positioning of visual aids.

It is yet another object of this invention to provide new and novel space dividers and enhancers which utilize uprights and horizontal supports to position fabric panels, such as drapes and/or other materials, articles and the like to divide spaces and/or enhance the appearance or use of the same for visual aids.

It is yet another object of this invention to provide a new and novel support connector positionable intermediate the upper and lower ends of otherwise supported uprights to facilitate positioning of space dividing and/or enhancing materials there between.

It is yet still another object of this invention to provide new and novel mounting and positioning of a pair of space dividers in close proximity to each other.

It is a further object of this invention to provide new and novel base and uprights for use with space dividers.

Other objects of this invention will hereinafter become obvious from the following description of the preferred embodiments and claims of this invention.

DESCRIPTION OF THE INVENTIVE EMBODIMENTS

Figure 1:
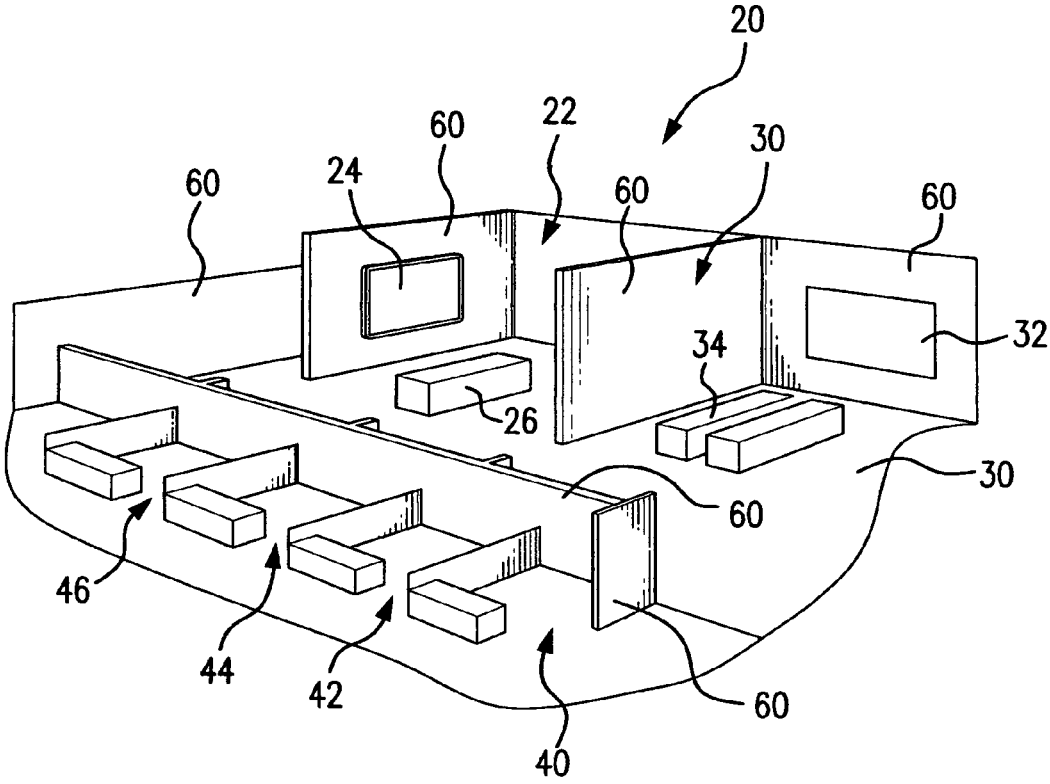
FIG. 1 is a schematic view of a space divided up for education, conferences and/or display trade show purposes.

With reference to FIG. 1 there is generally shown at 20 an overall space that is divided into smaller spaces such as a visual aid space 22 with a visual aid such as a video monitor, movie/projection screen, or the like 24. If desired, a number of chairs 26 or other seating may be provided in space 22. In addition, or in the alternative, a conference space 30 with a chalk or writing board 32, and with tables and seating 34 may also be provided. Other smaller spaces such as spaces 40, 42, 44, 46 may also be divided from overall space 20. Other sizes, configurations and arrangements of divided spaces for the same, similar or other purposes are possible and are facilitated by the subject matter of this invention.

Figure 4:
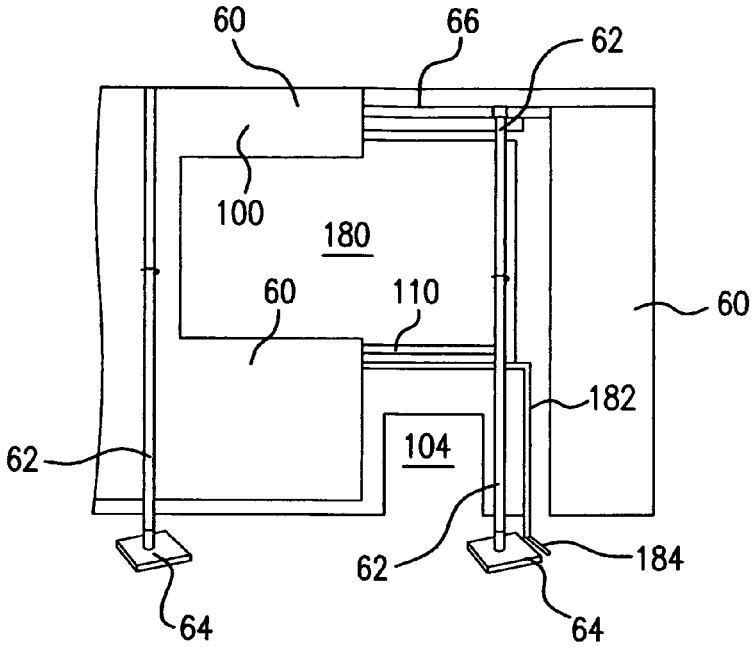
FIG. 4 is a front elevation view, similar to FIG. 2, but with the drapes opened to better show details of how the drapes are hung and a visual aid is positioned.
Figure 5:
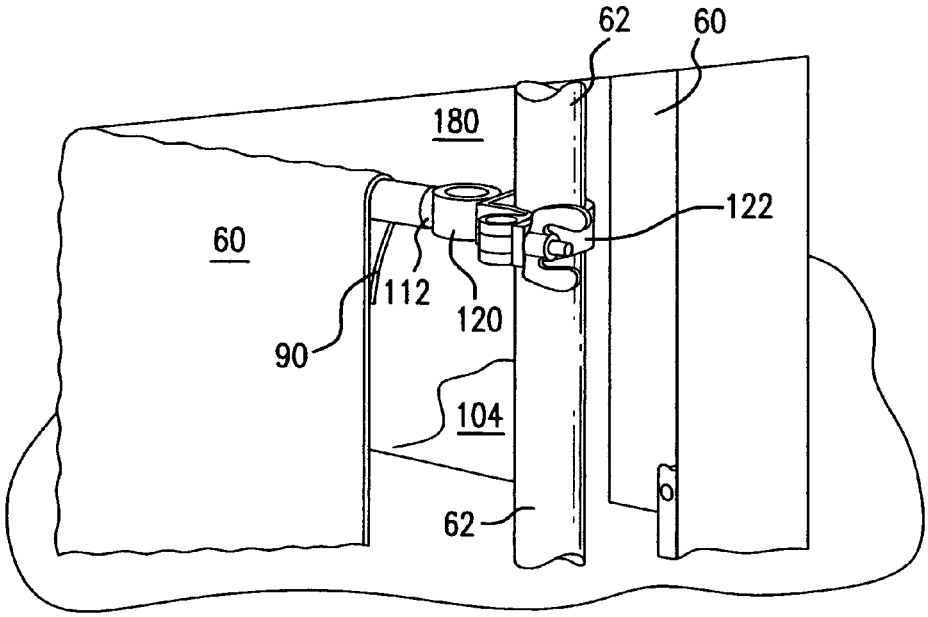
FIG. 5 is an enlarged view of an intermediate support member positionable receiver and retainer assembly, incorporating the instant invention, connecting an intermediate horizontal support to an upright.
Figure 6:
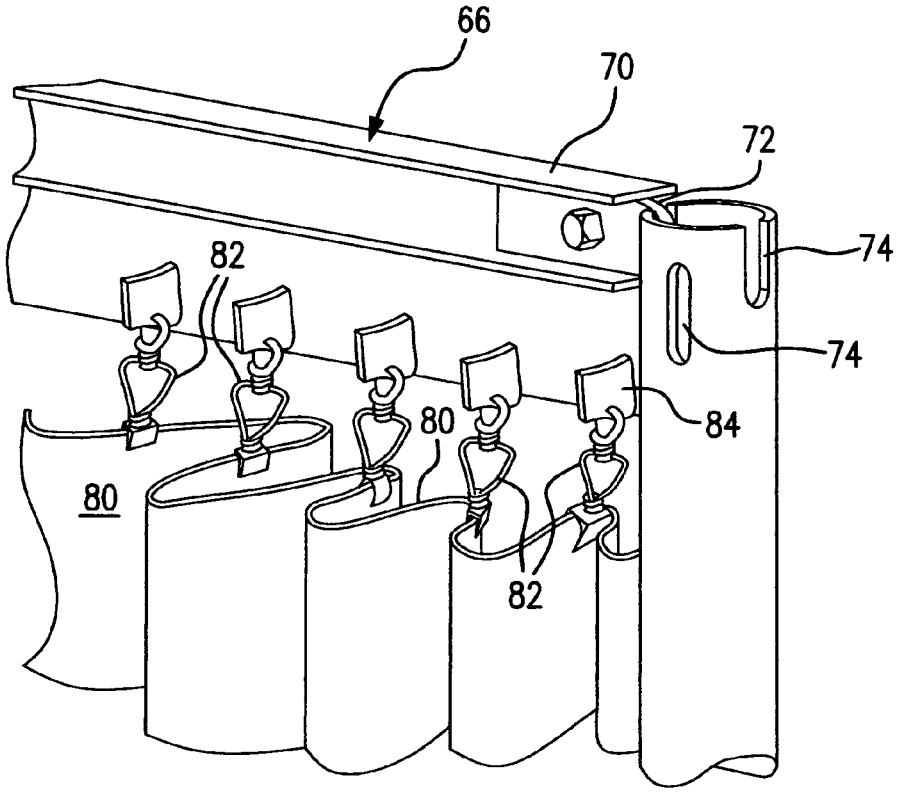
FIG. 6 is a partial perspective view of an alternative drape carrier bar for use in dividing spaces.

Overall space 20 and the respective divided spaces 22, 30, 40, 42, 44, 46 are defined by and separated from each other by separators such as event drapery 60 (FIGS. 1-5). Vertical supports, such as posts or uprights 62 (FIGS. 4 and 5), supported in conventional manner by, and extending up from, base plates 64 (FIGS. 3 and 4), are spaced from each other by upper supports 66, such as upper bars 68 or 70 (FIG. 6). Upper bars 68 are shown as tubular and generally horizontally disposed bars while bars 70 are more track-like in configuration, but also are generally horizontally disposed. Other configurations, constructions and dispositions may be provided for upper supports 66.

Upper supports 66 whether tubular such as bars 68 or track like such as 70, are provided at their respective ends with hook-like connectors 72 (FIG. 6) that engage and seat in slots 74 (FIG. 6) formed in or proximate upper extremities of uprights 62.

Figure 2:
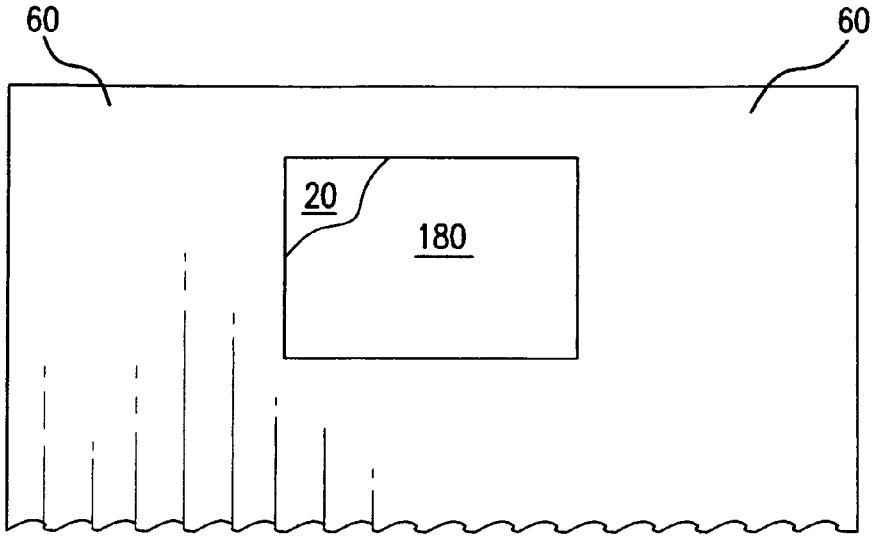
FIG. 2 is a front elevation view of a divider incorporating the instant invention that could be used to divide spaces such as those shown in FIG. 1.
Figure 3:
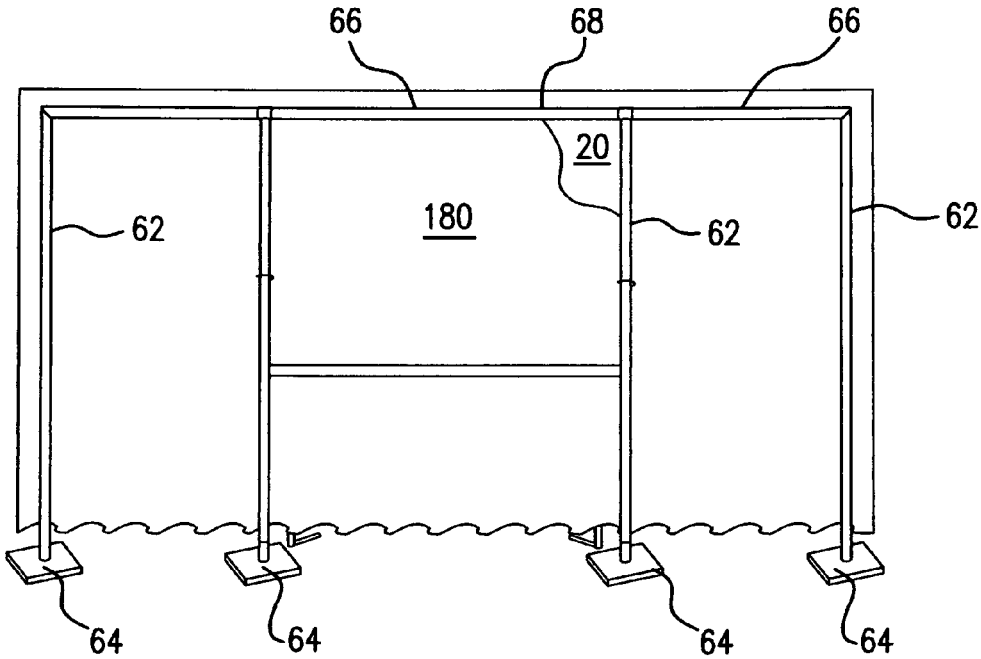
FIG. 3 is a rear exposed elevation view of the divider of FIG. 2.

FIG. 6 shows a drapery 80 provided with drapery hooks 82 that are carried by travelers 84 that are, in turn, supported by and move along support track 70. Event drapery, such as drapery 60, however, are often formed with a rod pocket 90 (FIG. 5) sized and configured to receive support bars such as upper support bars 68 (FIG. 4). When drapery 60 is so disposed between uprights 62 and supported by support bars 68, they would appear from the front as shown in FIG. 2 and from the rear as shown in FIG. 3.

It is often important to provide a divided space with a place where a visual aid, such as a monitor, projection screen, writing board, or the like, or a poster, chart or other marketing or sales display may be positioned. To position such visual aid or sales display, etc. in front of or hang it on, the event drapery may not be acceptable. For convenience all of the aforementioned will be referred to as visual aids.

The instant invention provides for a window-like visual aid space 22 (FIGS. 3 and 4) disposed and positioned between a pair of uprights 62 (FIG. 3) and between the support bar 68 separating and spacing those uprights 62 and the floor or surface upon which the base plates 64, which the uprights 62, are positioned. An upper drape 100 (FIGS. 2 and 4) is fabricated with a width and length selected to drape whatever space 102 (FIG. 4) is left between upper support bar 68 and an upper edge of visual aid space 22 and with a rod pocket (not shown) similar to rod pocket 90 (FIG. 5). Upper drape 100 may then be positioned on upper support bar 68 either before the support bar 68 is secured in place, as hereinabove described, or by having the hook 72 (FIG. 6) at one end of its upper support bar 68 (FIG. 3) lifted out of its co-acting slot 74 (FIG. 6) at the top of its upright 62.

Figure 10:
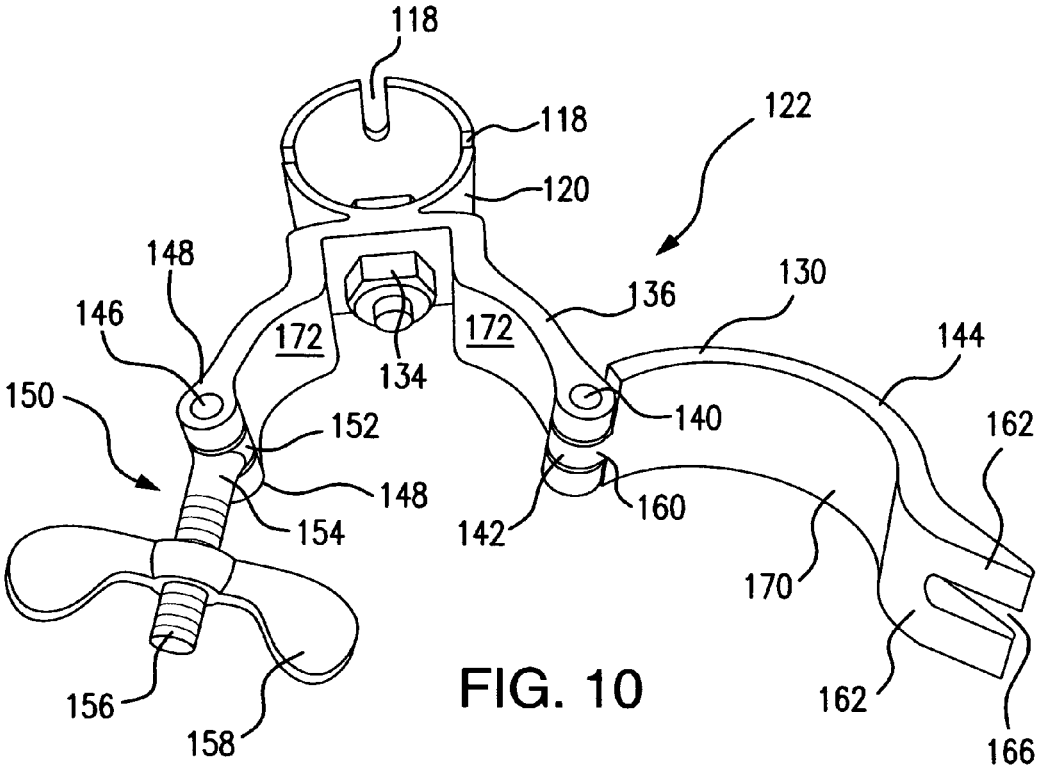
FIG. 10 is a perspective view of the receiver and retainer assembly of FIGS. 5 and 7-9.
Figure 11:
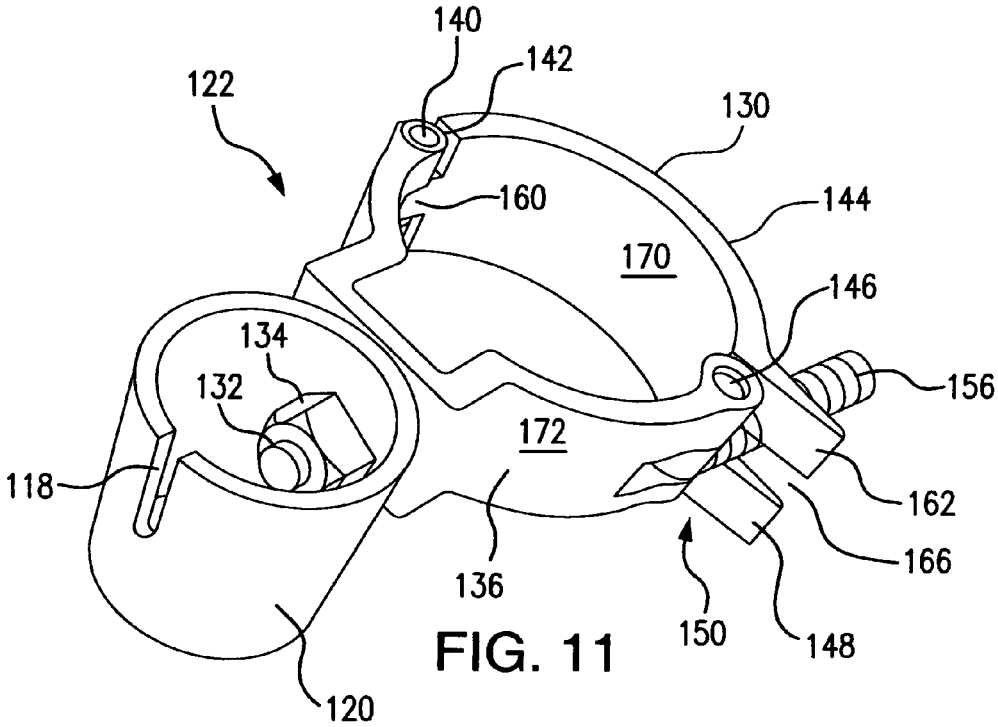
FIG. 11 is a schematic perspective view of the receiver and retainer assembly of FIG. 10.

The remaining space 104 (FIG. 4) below window-like visual aid space 22 is also to be draped for aesthetic and other reasons. The lower edge of visual aid space 22, as well as the upper extremity of lower space 104 is defined by an intermediate support bar 110 (FIGS. 3-4 and 7-9) which may be similar in construction and configuration to either a support bar 68 or a support bar 70. Intermediate support bar 110 is to be of a length to fit between the uprights 62 that define the sides of the selected visual aid space 22. Hook-like connectors 112 (FIGS. 7 and 8), similar to connectors 72 (FIG. 6), are provided at each end of intermediate support bar 110 (only one end shown (FIGS. 7 and 8)) and may be secured in place by threaded members or rivets 114. The hook end of each such connector 112 is sized, configured and formed to be inserted into and to be seated in a slot 118 (FIGS. 7, 10 and 11) suitably formed in a receiver 120 (FIGS. 5 and 7-11) of a receiver and retainer assembly 122.

Receiver 120 may be secured to a retainer 130 (FIGS. 10 and 11) as by an externally threaded member such as a bolt 132 that extends through suitably formed and positioned openings (not shown) in receiver 120 and a fixed member 136 of retainer 130 respectively. An internally threaded nut 134 is threaded onto bolt 132 and when tightened secures retainer 120 and receiver 130 together to form retainer and receiver assembly 122. Other means, such as rivets or welding may be utilized instead to secure receiver 130 and retainer 120 together to form receiver and retainer assembly 122.

A first pivot pin 140 (FIGS. 10 and 11) extends through spaced arms 142 disposed at one end of fixed member 136 and pivotally connects fixed member 136 and a clamping member 144 together. A second pivot pin 146 extends through spaced arms 148 disposed at the other end of fixed member 136 and pivotally connects a securing device 150 (FIGS. 10 and 11) and fixed member 136 together. Securing device 150 is formed with a substantially donut-like head end 152 with an opening (not shown) extending there through and a shank portion 154 extending there from with external threads 156 at its other end. An internally threaded wing nut 158 is threaded onto threads 156 for purposes to be explained.

Figure 7:
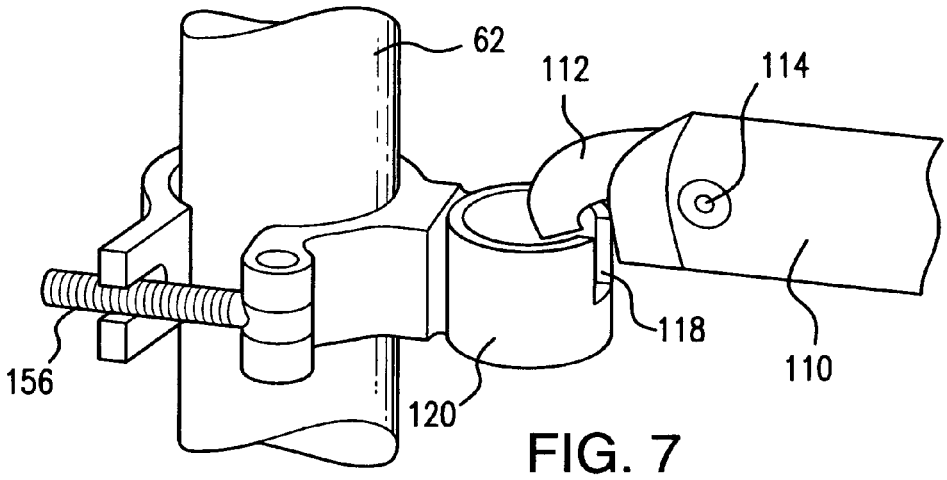
FIG. 7 is a perspective view of hook end of an intermediate support shown as it is positioned while being inserted into a receiver and retainer assembly incorporating the instant invention.
Figure 8:
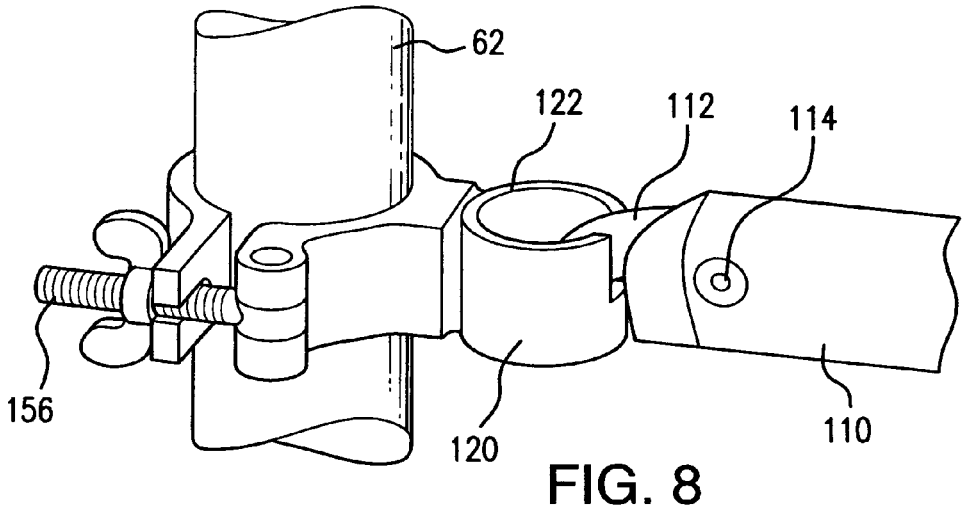
FIG. 8 is a perspective view of the hook end of the intermediate support of FIG. 7 showing same fully inserted into the receiver and retainer assembly of FIG. 7.

Clamping member 144 is formed with a connecting end 160 (FIG. 10) at one end with an opening extending there through to receive pivot pin 140 so as to permit rotation of clamping member 144 with respect to fixed member 136. A pair of spaced arms 162 are formed at the other end of clamping member 144 so as to extend out there from and so as to provide a securing space opening 166 at an end. A body 170 is provided between the ends of clamping member 144 and a similar body 172 is provided between the ends of fixed member 136. Each body 170, 172 is configured and sized to fit about and be clamped to the external surface of an upright 62, as shown in FIGS. 5, 7 and 8. As shown uprights 62 are tubular and cylindrical. The uprights could just as well be triangular, square, rectangular, hexagonal, octagonal or any other configuration and, as such, the co-acting retainer bodies would be similarly configured and sized.

Figure 9:
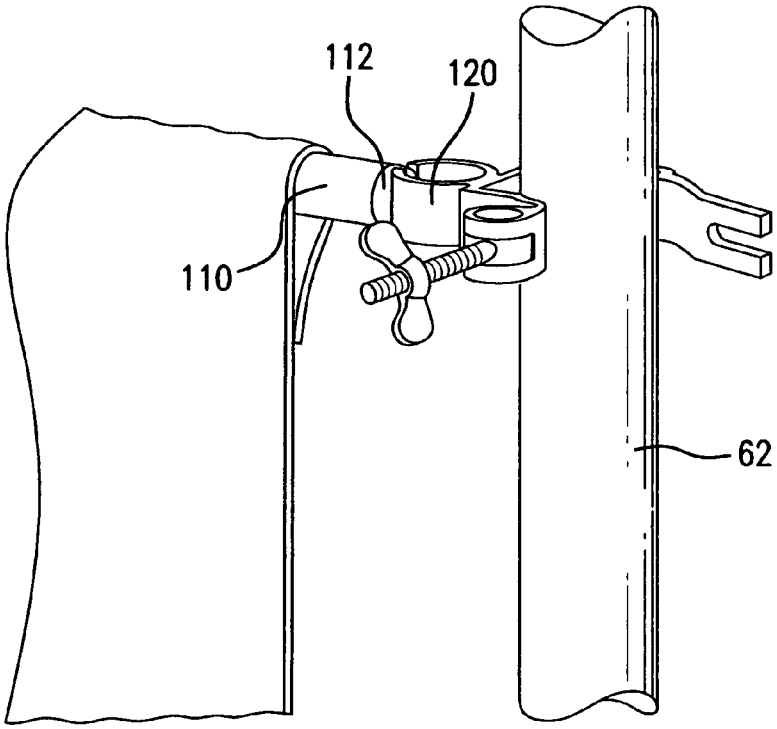
FIG. 9 is a perspective view of the receiver and retainer assembly of FIGS. 7 and 8 open and being positioned about an upright to secure an intermediate support to the upright.

Thus, when a lower edge, that is to be defined, and a lower space 104 is to be covered, as by a skirt or lower drapery 60, that is accomplished by an intermediate support bar 110. A receiver and retainer assembly 110 is positioned in an open configuration as shown in FIG. 9 with its respective bodies 170, 172 disposed in proximity and about an upright 62. Clamping member 144 is rotated in a clockwise direction (FIG. 10) about pivot pin 140 and so its body 170 is disposed against the outer surface of upright 62. Securing device 150 is pivoted counter-clockwise about pivot pin 146 until its shank portion (154) is disposed in opening 166 and wing nut 158 is threaded onto threads 156 until receiver and retainer 122 are secured in position on upright 62 with its receiver 120 disposed in lower space 104 to receive the hook end of a connector 112 carried by the intermediate support bar 110 that is to be used. A second receiver and retainer assembly 122 is similarly disposed on and secured to the other upright defining lower space 104 to receive and support the other end of the intermediate support bar 110. Drape 60 is suitably sized and configured and is disposed on and carried by the so positioned intermediate support bar 110.

It should thus be seen that a receiver and retainer assembly 122 may be infinitely positionable along an upright 62 to support an intermediate support and to accommodate a visual aid space and provide a support for a lower space of any selected size.

The visual aid to be positioned in visual aid space 22, in this instance, is a screen 180 upon which film or slides may be projected. Screen 180 is supported by a frame 182 (FIG. 4) and legs 184 (only one shown).

Figure 12:
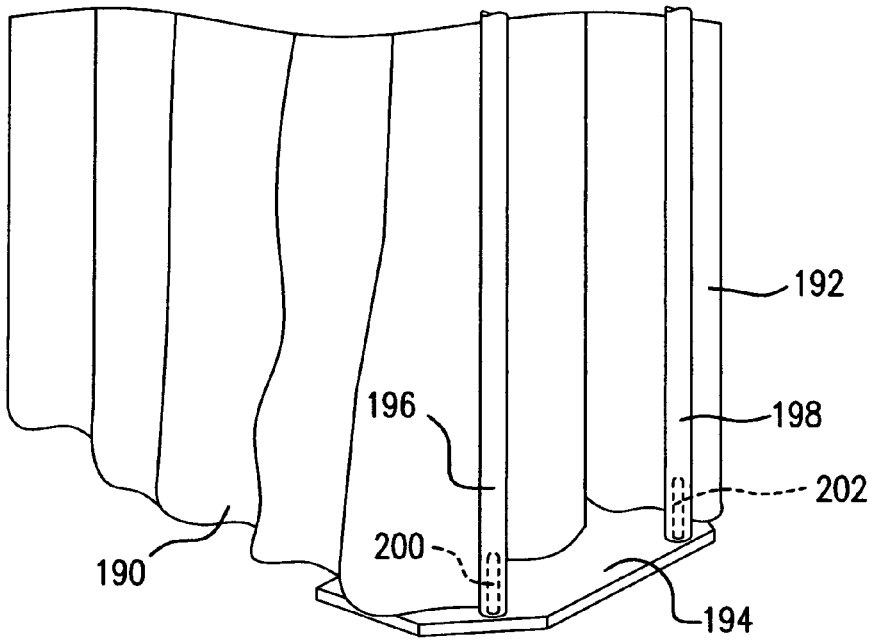
FIG. 12 is a perspective view of a pair of fabric space dividers, in the form of drapes, mounted in relatively close positions by the use of a base plate with multi-uprights incorporating the instant invention.

At times, it is desired to cover the back side of a first space divider, such as a first drapery 190 (FIG. 12) by another space divider such as a second drapery 192, but with their respective backs facing each other so that the respective face sides of the drapery are what is shown. Space within an event space is often at a premium so a relatively close disposition of the two draperies is obtained by fabricating a base plate 194 so as to accommodate and support a pair of spaced uprights 196, 198. The instant invention also eliminated the need for the use of a second base, thus simplifying a set up requirement. Upwardly extending support pins 200 and 202 are secured to base plate 194 to receive uprights 196 and 198 respectively. Conventionally available securing means secure uprights 196 and 198 in vertical and spaced dispositions on pins 200, 202 respectively.

While only certain specific preferred embodiments of the invention have been described, it is understood that many variations thereof are possible without departing from the principals of this invention as defined in the following claims.

What is claimed is:

1. A receiver and retainer assembly, to facilitate positioning a cross-member on a support of predetermined height, length and width and which within the predetermined height, length and width configures a three dimensional, 3-D space, the cross-member being of selected length and width and carrying at each of its respective ends an attacher of plate material of predetermined thickness and with each such attacher having a slot of selected size extending inwardly from an edge of the attacher a selected amount so that each such attacher appears to be hook-like in configuration; the receiver and retainer assembly comprising:

a. at least one clamping member configured to be positioned on the support, at a selected position intermediate ends of the support and without having to be applied thereto over an end of the support, to facilitate securing the cross-member to the support;

b. at least one retainer physically attached to and extending directly from said clamping member for receiving and retaining one of the ends of the cross-member; and c. said retainer including at least one slot open at its top and which is sized and configured to receive and position the attacher from one of the ends of the cross-member so that said slot receives the attacher and the slot of the attacher is received by the retainer and so that the attacher can only be separated from the retainer by movement substantially in the direction opposite to the direction the attacher was moved when the attacher was inserted into the retainer, there being substantially no other relative movement between the retainer and the attacher;

d. said retainer facilitating positioning the cross-member on the support and within the 3-D space configured by the support.

2. The receiver and retainer assembly of claim 1 wherein the support is to be disposed in a substantially vertical or upright position and the cross-member is to be disposed in a substantially horizontal disposition.

3. The receiver and retainer assembly of claim 2 wherein the support is to be connected in spaced relationship with another support across at least their tops and are each mounted at its respective lower end on a base plate and wherein the cross-member is to be disposed intermediate the respective tops and base plates.

4. The receiver and retainer assembly of claim 3 wherein there is one of the retainers and one of the clamping members secured to each other for each end of the cross-member to position and secure the cross-member between and to the respective supports.

5. A receiver and retainer mounting arrangement for positioning a cross-member intermediate the ends of a pair of spaced uprights connected in spaced relationship proximate their respective upper ends by a cross-support and positioned in spaced relationship proximate their lower ends each by a base plate, such that the pair of spaced uprights and the cross-support define between them a three dimensional 3-D space, the cross-member being sized to be disposed between the respective uprights and carrying at each of its respective ends an attacher of plate material of predetermined thickness and with each such attacher having an attacher slot of selected size extending inwardly from an edge of the attacher a selected amount so that each such attacher appears to be hook-like in configuration, the receiver and retainer mounting arrangement including:

a. a first receiver and retainer assembly for positioning a first end of the cross-member proximate a first one of the uprights and a second receiver and retainer assembly for positioning a second end of the cross-member proximate a second one of the uprights;

b. each said receiver and retainer assembly being physically and directly attached to a clamping member and including a retainer; and c. each said retainer including at least one slot open at its top and which is sized and configured to receive and be hooked together with one of the attachers carried by the cross-member to position the cross-member intermediate the respective upper ends and the lower ends of the respective uprights even while such are so connected and positioned so that the slot of the retainer receives the attacher and the slot of the attacher is received by the retainer and so that the attacher can only be separated from the retainer by movement substantially in the direction opposite to the direction the attacher was moved when the attacher was inserted into the retainer, there being substantially no other relative movement between the retainer and the attacher;

d. each said receiver and retainer assembly facilitating positioning the cross-member between the pair of spaced uprights and within the 3-D space configured by the uprights and the cross-support.

6. The receiver and retainer mounting arrangement of claim 5 wherein the uprights are hollow pipe-like members of predetermined cross-sectional configuration, and said clamping members are configured with a similar cross sectional configuration as the uprights and to substantially surround an upright and be clamped in place thereabout.

7. The receiver and retainer mounting arrangement of claim 6 wherein said predetermined cross-sectional configuration is circular.

8. The receiver and retainer mounting arrangement of claim 5 wherein the uprights are to be disposed in substantially vertical or upright positions and the cross-member is to be disposed in a substantially horizontal disposition.

9. A receiver and retainer assembly to facilitate positioning a cross-member, having plate-like and hook-like attachers at its respective ends, between a pair of spaced supports intermediate the ends of the respective spaced supports, the pair of spaced supports being of a predetermined thickness and defining there-between a three dimentional 3-D space of the same thickness as that of the pair of spaced supports, comprising:

a. retainer means for receiving and retaining the cross-member; and b. clamping means secured physically with and directly to said retainer means and configured to position and secure said retainer means intermediate the ends of the spaced supports;

c. said retainer means including a retainer for each of the respective ends of the cross-member with each said retainer including at least one slot open at its top and which is sized and configured to receive and be hooked together with one of the attachers carried by the cross-member to position the cross-member intermediate respective upper ends and lower ends of the uprights even while such are so connected and positioned so that the slot of the retainer receives the one of the attachers and wherein the attacher can only be separated from the retainer by movement substantially in the direction opposite to the direction the attacher was moved when the attacher was inserted into the retainer, there being substantially no other relative movement between the retainer and the attacher;

d. said receiver and retainer assembly facilitating positioning the cross-member between the pair of spaced supports and within the 3-D space defined by the supports.

10. A receiver and retainer mounting arrangement for positioning a cross-member intermediate the ends of a pair of spaced uprights connected in spaced relationship proximate their respective upper ends by a cross-support and positioned in spaced relationship proximate their lower ends each by a base plate so that the pair of spaced uprights and the cross-support configure between themselves a three dimensional, 3-D space, the cross-member being sized to be disposed between the respective uprights and carrying at each of its ends a plate-like, hook-like attacher, the receiver and retainer mounting arrangement comprising:

a. first receiver and retainer means for positioning a first end of the cross-member proximate a first one of the uprights and second receiver and retainer means for positioning a second end of the cross-member proximate a second one of the uprights;

b. each said receiver and retainer means including a retainer for receiving one of the hook-like attachers of the cross-member and each said first receiver and retainer means and said second receiver and retainer means including a clamping member physically and directly secured to a respective one of said retainer means and being sized and configured to secure its respective receiver and retainer means intermediate the respective upper ends and lower ends of the respective uprights even while such are so connected and positioned;

c. each said retainer including at least one slot open at its top and which is sized and configured to receive and be hooked together with one of the attachers carried by the cross-member to position the cross-member intermediate the respective upper ends and the and lower ends of the respective uprights even while such are so connected and positioned so that the slot of the retainer receives the attacher and wherein the attacher can only be separated from the retainer by movement substantially in the direction opposite to the direction the attacher was moved when the attacher was inserted into the retainer, there being substantially no other relative movement between the retainer and the attacher;

d. each said receiver and retainer means facilitating positioning the cross-member between the pair of spaced uprights and within the 3-D space configured by the uprights and the cross-support.

11. The receiver and retainer mounting arrangement of claim 10 wherein the uprights are hollow pipe-like members of predetermined cross-sectional configuration, and said clamping members are configured with a similar cross sectional configuration as the uprights and to substantially surround an upright and be clamped in place thereabout.

12. The receiver and retainer mounting arrangement of claim 11 wherein said predetermined cross-sectional configuration is circular.

* * * * *